US008955254B1

(12) United States Patent
Ewoldt

(10) Patent No.: US 8,955,254 B1
(45) Date of Patent: Feb. 17, 2015

(54) SELF-STORING SECURITY DOOR ASSEMBLY

(71) Applicant: Unique Home Designs, Inc., Gilbert, AZ (US)

(72) Inventor: John O. Ewoldt, Gilbert, AZ (US)

(73) Assignee: Unique Home Designs, Inc., Gilbert, AZ (US)

( * ) Notice: Subject to any disclaimer, the term of this patent is extended or adjusted under 35 U.S.C. 154(b) by 0 days.

(21) Appl. No.: 13/749,546

(22) Filed: Jan. 24, 2013

Related U.S. Application Data

(60) Provisional application No. 61/590,105, filed on Jan. 24, 2012.

(51) Int. Cl.
*E05B 65/04* (2006.01)
*E06B 3/72* (2006.01)
*E06B 3/968* (2006.01)

(52) U.S. Cl.
CPC .. *E06B 3/72* (2013.01); *E06B 3/968* (2013.01)
USPC ..... 49/62; 49/65; 52/656.4; 52/204.51

(58) Field of Classification Search
USPC ..... 52/656.1, 656.2, 656.3, 656.4, 656.5, 52/204.51, 204.62, 656.7, 202, 203; 49/61, 62, 63, 64, 65, 463
See application file for complete search history.

(56) References Cited

U.S. PATENT DOCUMENTS 1,207,885 A * 12/1916 Estabrook ..... 160/37
1,275,531 A * 8/1918 Clews ..... 292/242
1,515,091 A * 11/1924 Brower et al. ..... 292/204
1,704,869 A * 3/1929 Pierson ..... 292/240
1,764,118 A * 6/1930 Potterf ..... 292/241
1,961,006 A * 5/1934 Marty ..... 52/800.16
2,540,864 A * 2/1951 Carter ..... 160/37
2,607,408 A * 8/1952 Bascom ..... 160/37
2,818,610 A * 1/1958 Pengelly ..... 49/451
3,024,837 A * 3/1962 McPhail ..... 160/91
3,177,924 A * 4/1965 McPhail ..... 160/91
3,269,452 A * 8/1966 Pirozzi ..... 160/90
3,383,799 A * 5/1968 Anderson ..... 49/397
3,414,039 A * 12/1968 King ..... 160/90
4,001,972 A * 1/1977 Hurwitz ..... 49/380
4,102,545 A * 7/1978 Jay ..... 292/57
4,311,183 A * 1/1982 Herbst et al. ..... 160/37
4,554,770 A * 11/1985 Anders ..... 52/204.51
4,949,771 A * 8/1990 Grisham et al. ..... 160/90
5,012,616 A * 5/1991 Martin ..... 49/501
5,327,684 A * 7/1994 Herbst ..... 49/506
5,423,149 A * 6/1995 Herbst ..... 49/382
5,469,666 A * 11/1995 Lewis, Jr. ..... 49/471

(Continued)

*Primary Examiner* — James Ference
(74) *Attorney, Agent, or Firm* — Booth Udall Fuller, PLC

(57) ABSTRACT

A self-storing security door assembly including a door frame and a self-storing glass sub-assembly is disclosed. The door frame may include four side members and a freeze bar extending two opposing side members. The freeze bar may also divide a first portion of the door frame from a second portion of the door frame. A glass section may be coupled over the first portion of the door frame, and a screen section may be coupled over the second portion of the door frame. The self-storing glass sub-assembly may be coupled to the door frame included two protruding tracks. Each protruding track may include a channel and be positioned on an interior edge of opposing side members. At least two opposing side members may also include a recessed track on an interior edge. Each recessed track may include a channel between the protruding track and the respective side member.

14 Claims, 13 Drawing Sheets

(56) References Cited

U.S. PATENT DOCUMENTS

| | | | | |
|---|---|---|---|---|
| 5,634,508 | A * | 6/1997 | Herbst | 160/371 |
| 5,803,145 | A * | 9/1998 | Lamb | 160/90 |
| 5,887,391 | A * | 3/1999 | Shoup | 52/202 |
| 6,256,931 | B1 * | 7/2001 | Kenkel et al. | 49/450 |
| 6,618,998 | B1 * | 9/2003 | Thomas et al. | 52/63 |
| 6,941,997 | B2 * | 9/2005 | Butler | 160/92 |
| 7,866,118 | B1 * | 1/2011 | Hamblin et al. | 52/784.1 |
| 2008/0018117 | A1 * | 1/2008 | Yeremian | 292/197 |
| 2008/0110094 | A1 * | 5/2008 | Davies | 49/63 |
| 2010/0300036 | A1 * | 12/2010 | Gunther et al. | 52/762 |

* cited by examiner

SELF-STORING SECURITY DOOR ASSEMBLY

CROSS REFERENCE TO RELATED APPLICATIONS

This document claims the benefit of the filing date of U.S. Provisional Patent Application 61/590,105, entitled "SELF-SECURING SCREEN DOOR ASSEMBLY" to John Ewoldt which was filed on Jan. 24, 2012, the contents of which are hereby incorporated by reference.

BACKGROUND

1. Technical Field

Aspects of this document relate generally to security door assemblies.

2. Background Art

Security doors are a common feature in many homes, providing either an added measure of security to a traditional door or a secure door even when the traditional door is open. Various varieties and models of security or storm doors are presently available to consumers. Many security or storm doors, however, have drawbacks in functionality or utilization by the consumer. For example, handle placement may injure a user's hands, fasteners may not secure the glass to door frame, or poorly designed nylon pins may fail to properly hold the glass panel within the frame. Each of these shortcomings and various others prevent the long-term functionality of the self-storage glass door, while increasing the risk of user injury.

SUMMARY

A first aspect of a security door comprises a reversible door frame, a freeze bar, a self-storing glass sub-assembly, and a recessed track. The reversible door frame comprises a first side member coupled to a second side member, a third side member coupled to the second side member opposite the first side member, and a fourth side member coupled to the first and third side members opposite the first side member. The freeze bar extends between the second side member and the fourth side member and divides a first portion of the door frame from a second portion of the door frame. The self-storing glass sub-assembly removably is coupled to the door frame and adapted to receive a removable glass section slidably coupled within the self-storing glass sub-assembly. The self-storing glass sub-assembly further comprises one protruding track on each side of the self-storing glass sub-assembly. Each protruding track comprises a first channel and positioned on an interior edge of a different one of the second and fourth side members. The self-storing glass sub-assembly is further configured to remove from the door frame, be rotated 180 degrees and be re-coupled to the door frame. The recessed track on the interior edge of each of the second and fourth side members is formed between the protruding track and the respective second or fourth side members of the reversible door frame. The recessed track is adapted to removably receive a removable glass section and one of a removable glass section and a removable screen section.

In particular implementations and embodiments, the security door may comprise one or more of the following. A first glass section may be removably coupled to the door frame within the second channels of the second and fourth side members, the first glass section sized to cover substantially all of the first portion of the door frame. A screen section may be removably coupled to the door frame within the second channels of the second and fourth side members, the screen section sized to cover substantially all of the second portion of the door frame. A second glass section may be slidably coupled to the door frame within the first channels of the second and fourth side members, the second glass section movable between a first position covering substantially all of the first glass section and at least a second position covering substantially all of the screen section. The second glass section may be movable between the first position, the second position, and a third position partially covering both the first glass section and the screen section. The self-storing glass sub-assembly may comprise a counterbalance spring mechanism coupled to the second glass section and configured to maintain the second glass section positionally within the first channels anywhere along the first channels. A latching element that removably couples the second glass section to the protruding tracks when the second glass section is in the second position. A hand hold element extending from the second glass section. A handle removably coupled to either the second side member or the fourth side member proximate the freeze bar, wherein the freeze bar may be positioned approximately halfway between the first side member and the second side member. The self-storing glass sub-assembly may further comprise two track side members each extending between the two protruding tracks and four corner keys, each corner key of the four corner keys coupling one protruding track of the two protruding tracks to one track side member of the two track side members at a different corner of the self-storing glass sub-assembly. Each corner key of the four corner keys may comprise two coupling elements positioned such that a first of the two coupling elements slidably engages within one protruding track and a second of the two coupling elements slidably engages within one track side member to couple the one protruding track and the one track side member at about a 90 degree angle. A safety stop may be coupled to the self-storing glass sub-assembly proximate one of the two side track members.

A security door assembly comprises a reversible door frame and a self-storing glass sub-assembly. The reversible door frame comprises a first side member coupled to a second side member, a third side member coupled to the second side member opposite the first side member, a fourth side member coupled to the first and third side members opposite the first side member, a freeze bar extending between the second and fourth side members and dividing the door frame into a first portion and a second portion, and a recessed track on an interior edge of each of the second and fourth side members, the door frame configured such that the first side member comprises a bottom side member in a first position and a top side member in a rotated second position. The self-storing glass sub-assembly is sized to cover the recessed tracks of the door frame when the self-storing glass sub-assembly is coupled to the door frame, the self storing glass sub-assembly comprising two opposing protruding tracks and two opposing track side members extending between the two protruding tracks, each protruding track comprising a first channel.

In particular implementations and embodiments, the security door assembly may comprise one or more of the following. A first glass section sized to fit within the recessed tracks of the second and fourth side members and cover substantially all of the first portion of the door frame. A screen section sized to fit within the recessed tracks of the second and fourth side members and cover substantially all of the second portion of the door frame. A second glass section sized to slide within the first channels of the protruding tracks. A handle configured to couple to second side member or the fourth side member. The self-storing glass sub-assembly may comprise a corner key at each corner, each corner key comprising two coupling elements positioned such that a first of the two coupling elements slidably engages within one protruding track and a second of the two coupling elements slidably engages within one track side member to couple the one protruding track and the one track side member at about a 90 degree angle. At least one safety stop may be coupled to the self-storing glass sub-assembly proximate at least one of the two side track members. The self-storing glass sub-assembly may comprise a counter balance spring mechanism.

A self-storing glass sub-assembly for coupling to a security door frame comprises track members, side members, and a counter balance spring mechanism. A first track member comprises a first channel. A first side member is removably coupled to the first track member with a first corner key. A second track member comprises a second channel and is removably coupled to the first side member opposite the first track member with a second corner key. A second side member is removably coupled to the second track member opposite the first side member with a third corner key and removably coupled to the first track member opposite the first side member with a fourth corner key.

In particular implementations and embodiments, the self-storing glass sub-assembly may comprise one or more of the following. A glass section slidably coupled to the first and second track members and slidable within the first and second channels. The counter balance spring mechanism may be configured to position the glass section anywhere along the first and second channels. Each of the corner keys may comprise two coupling elements slidably, each coupling element slidably engaged within one of the first track member, second track member, first side member, or second side member. At least one safety stop coupled to at least one of the first or second side members.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended security doors and/or assembly procedures for a security door will become apparent for use with implementations of a door frame and single track framing unit from this disclosure. Accordingly, for example, although particular glass sections, screen sections, tracks, side members, counter balance springs, stop elements, latching elements is disclosed, such elements and implementing components may comprise any shape, size, style, type, model, version, measurement, concentration, material, quantity, and/or the like as is known in the art for such door assemblies and implementing components, consistent with the intended operation of a door assembly.

Figure 1:
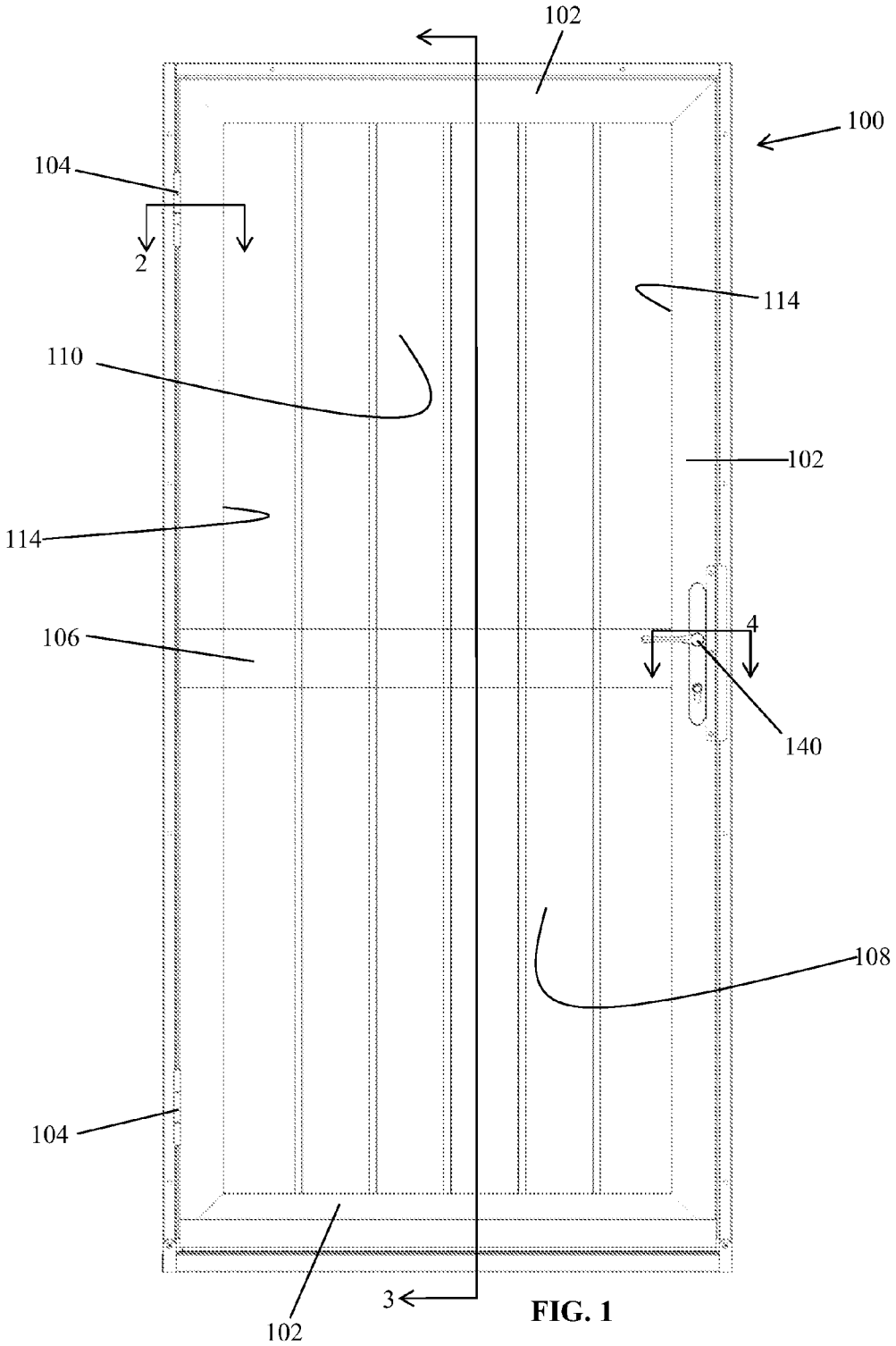
FIG. 1 is a rear view of a door assembly.

The utilization of a self-storing security door assembly as described herein has numerous advantages over the prior art. Any reference to dimensions in either the figures or the description is for exemplary purposes only, and not used for limitation. As shown in FIG. 1, an implementation of a self-storage glass or security door assembly may comprise a main door frame 100 divided into at least a first portion 108 and a second portion 110.

As shall be described in greater detail in this document, a self-storing door assembly may comprise a reversible door. In an embodiment, the main door frame 100 may be rotated 180 degrees from top to bottom to reverse the side of the door frame to which the handle 140 and the hinges 104 couple. For example, in an upright position, the door assembly may comprise the hinges 104 on the left side of the door frame 100, the handle 140 on the right side of the door, the first portion 108 of the main door frame 100 on the top, and the second portion 100 of the main door frame 100 on the bottom. If desired, a user may rotate the door 180 degrees, such that the handle 140 is on the left side of the door frame 100, the hinges 104 are on the right side of the door frame 100, the first portion 108 of the door frame 100 is on the top, and the second portion of the door frame 100 is on the bottom.

In cooperation with this reversibility feature, the various sections of material may be fixedly coupled to the first 108 and second 110 portions of the main door frame 100. For example, a user may fixedly couple a first glass section 132 to the first portion 108 of the main door frame 100 and a screen section 130 to the second portion 110 of the main door frame 100. If the main door frame 100 is rotated, the user may fixedly alternate the glass section 132 and the screen section 130. The glass section 132 may comprise any type of glass, such as but not limited to tempered stamp embossed glass. In other words, the glass 132 and screen 130 sections are each symmetrically fabricated to be interchangeable in the main door frame 100.

One or more embodiments of the door frame 100 comprise a plurality of side members 102, an example of which is shown in FIG. 1. In FIG. 1, the door frame comprises four side members 102 coupled together to form a substantially rectangular door frame 100. The main door frame may further comprise a freeze bar 106 coupled to opposing side members 102 and separating the first portion 108 of the door frame 100 from the second portion 110 of the main door frame 100. The first portion 108 and the second portion 110 are each typically holes or openings that extend all the way through the main door frame 100. As shall be shown and described in greater detail in subsequent figures, some embodiments of the main door frame 100 further comprise a recessed track 112 on the interior edge 114 of either or both the first half and the second half. The recessed track 112 may be configured such that when the glass section 132 or the screen section 130 is placed within the recessed track 112, the edges of the glass section 132 or screen section 130 are substantially level with or below the planar surface of the side members 102 of door frame 100. In other words, the glass 132 and screen sections 130 are recessed into the side members 102 of door frame 100.

Figure 9:
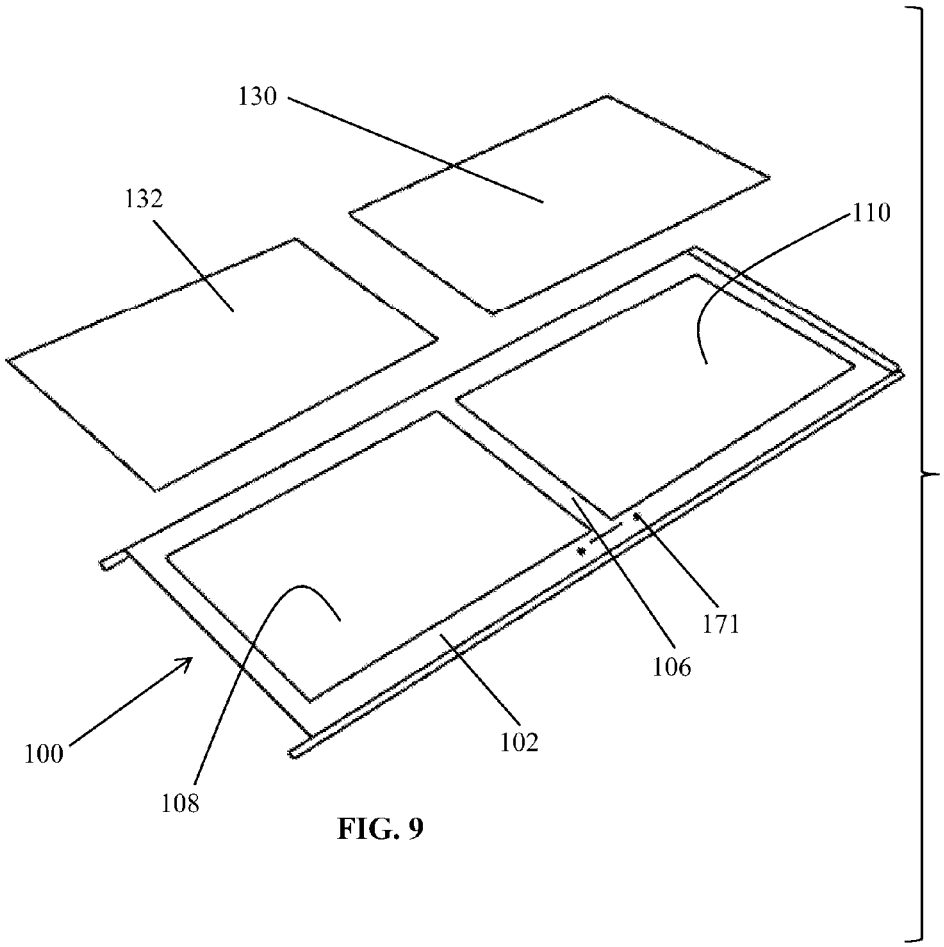
FIG. 9 is a perspective view of a door frame with a glass section and screen section separate from the door frame.

FIG. 9 illustrates an exploded view of an embodiment of a door frame 100. As previously described, the door frame 100 comprises a plurality of side members 102 and a freeze bar 106 extending between two opposing side members 102 and separating the first portion 108 from the second portion 110. A first glass section 132 and a screen section 130 are shown away from the first 108 and second 110 portions prior to coupling. FIG. 9 also illustrates a plurality of handle holes 171 that extend through one of the side members 202. The handle holes 171 are positioned to allow for easy coupling of a handle 140 to the door frame 100.

Figure 13:
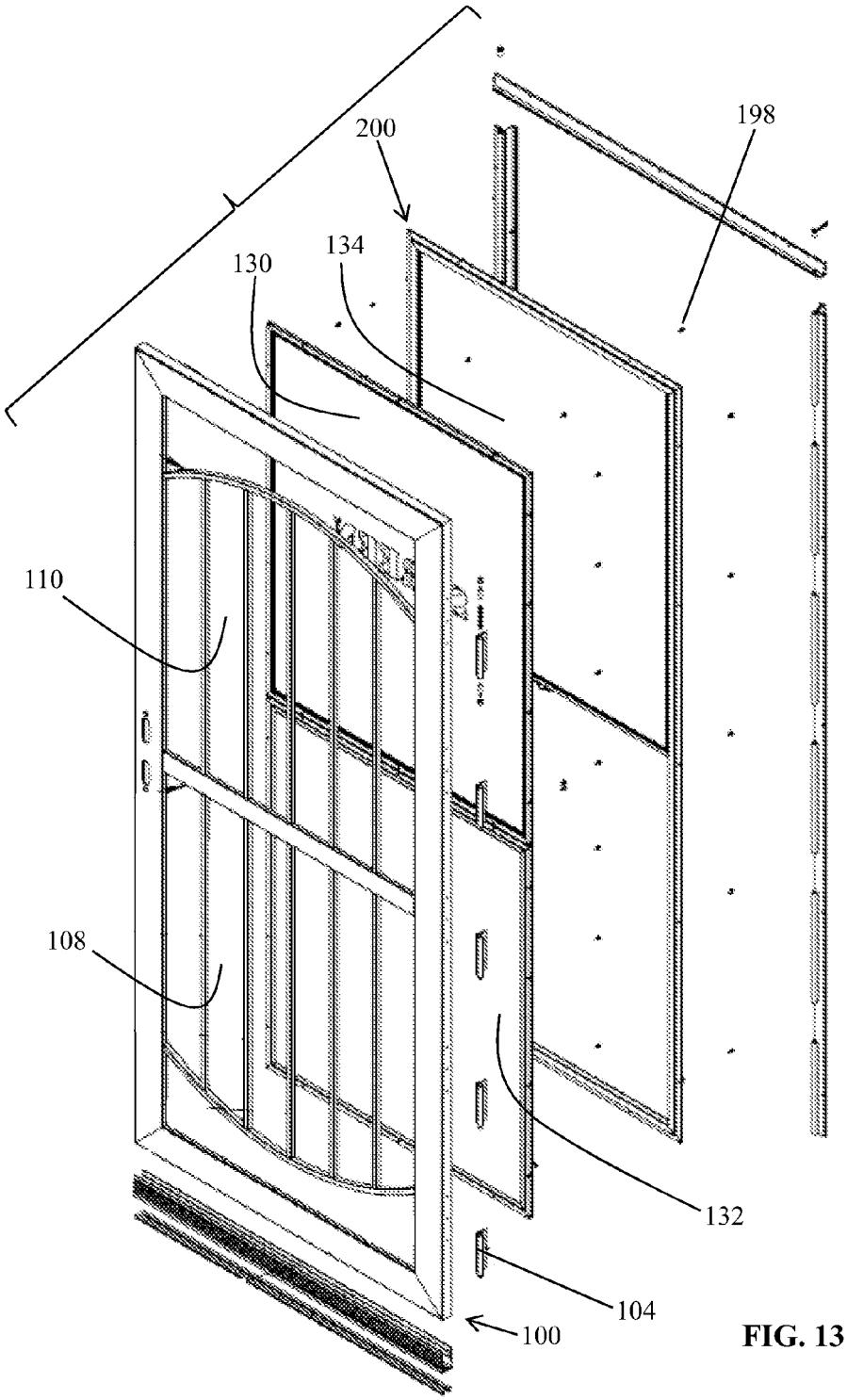
FIG. 13 is an exploded view of a self-storing security door assembly.

FIG. 13 illustrates an exploded view of an embodiment of a self-storing security door assembly, included the main door frame 100, the self-storing glass sub assembly 200, the screen section 130, the first glass section 132, the second glass section 134, the hinges 104, as well as other self-storing security door assembly components, such as but not limited to a jamb, a jamb latch, jamb hinges, a bug sweep, and a bug screen insert.

Figure 2:
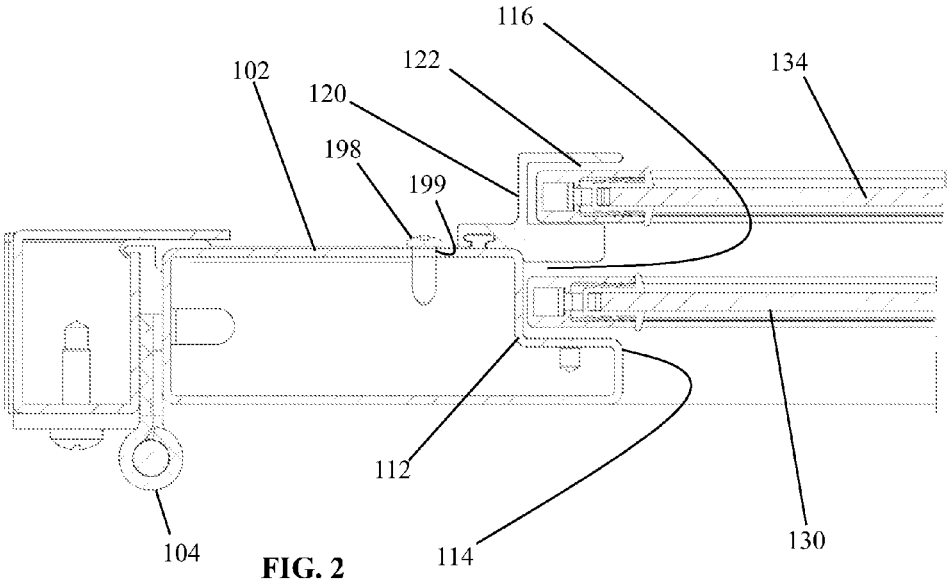
FIG. 2 is a cross sectional view of a door assembly as viewed from line 2 of FIG. 1.

FIG. 2 illustrates a partial cross-sectioned of a portion of the door assembly taken at line 2 of FIG. 1. As shown in the exemplary embodiment of FIG. 2, the door assembly may comprise the side member 102 of the door frame 100, the screen section 130 (or alternatively the glass section 132), and a sliding second glass section 132. FIG. 2 further illustrates one exemplary embodiment of the recessed track 112 of the main frame 100. The recess may allow the fixed glass 132 or screen sections 130 to sit below the surface level of the door frame 100. In the exemplary embodiment shown in FIG. 2, the recessed track 112 comprises two substantially perpendicular planar surfaces. One of the planar surfaces of the recessed track 112 is typically substantially perpendicular to the interior edge 114 of the respective side member 102, while the other planar surface is typically substantially perpendicular to the facial surface of the side member 102. In other alternative embodiments, however, the recessed track 112 may comprise any suitable configuration that allows the glass 132 and screen 130 sections to couple to the door frame 100 with the recessed tracks 112.

In one or more embodiments, as exemplified in FIG. 2, a recessed track 112 allows for the attachment or coupling of a self-storing glass sub-assembly 200 to the main door frame 100. Embodiments of the self-storing glass sub-assembly 200 are typically configured to be coupled to the door frame 100 over or in front of the recessed tracks 112 of the door frame 100. The self-storing glass sub-assembly 200 may comprise a self-contained unit capable of comprising any of or at least the following features: a single track aluminum frame comprising one or more protruding tracks 120 and one or more track side members 124, a counter spring 123 loaded inside a balance mechanism, a hand hold element 149, a latching mechanism, a safety stop 155, and/or corner keys 144.

One or more embodiments of the protruding track 120, such as that shown in FIG. 2, comprise a first channel 122. Each first channel 122 is typically sized to allow a portion of the slidable glass section 134 to fit and slide therein. Moreover, embodiments of the protruding tracks may also be configured to form, in combination with the recessed track 112 of the side members 102, a second channel 116 when the protruding track 120 is coupled over the recessed track 112. In such embodiments, a portion the fixed first glass section 132 and the fixed screen section 130 fit are fixedly or removably coupled within the second channel 116. When within the second channel 116, the screen section 130 and the first glass section 132 are typically below the plane of the facial surface of the side member 102.

In some embodiments, the self-storing glass sub-assembly 200 allows for a moveable or slidable second glass section 134 to be slid up and down within the protruding tracks 120 from the first portion 108 of the door frame to the second portion 110 of the door frame 100, or from the second 110 of the door frame 100 to the first portion 108 of the door frame 100. Such movement enables a user to cover either the fixed screen section 130 or fixed glass section 132, or portions of both the fixed screen section 130 and the fixed glass section 130.

Embodiments of a self-storing glass sub-assembly 200 are removably coupled to door frame 100 with one or more screws 198. The self-storing glass sub-assembly 200 and the door frame 100 typically comprise one or screw holes 100 positioned to align when both before and after 180° rotation of the self-storing glass sub-assembly 200. When screw holes 199 are aligned, one or more screws 198 couple the self-storing glass sub-assembly 200 to the door frame 100.

Figure 11:
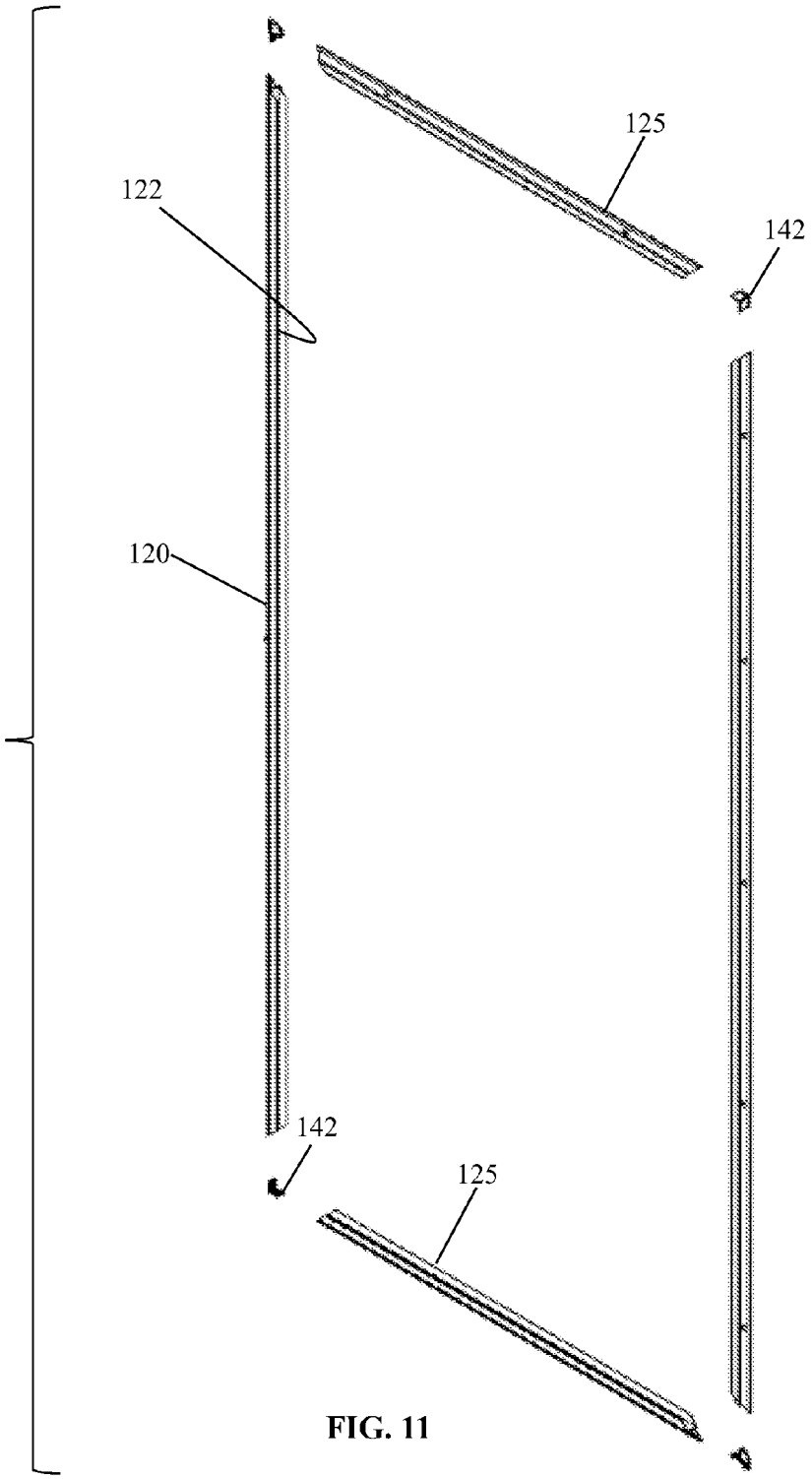
FIG. 11 is an exploded view of a self-storing glass sub-assembly.
Figure 12:
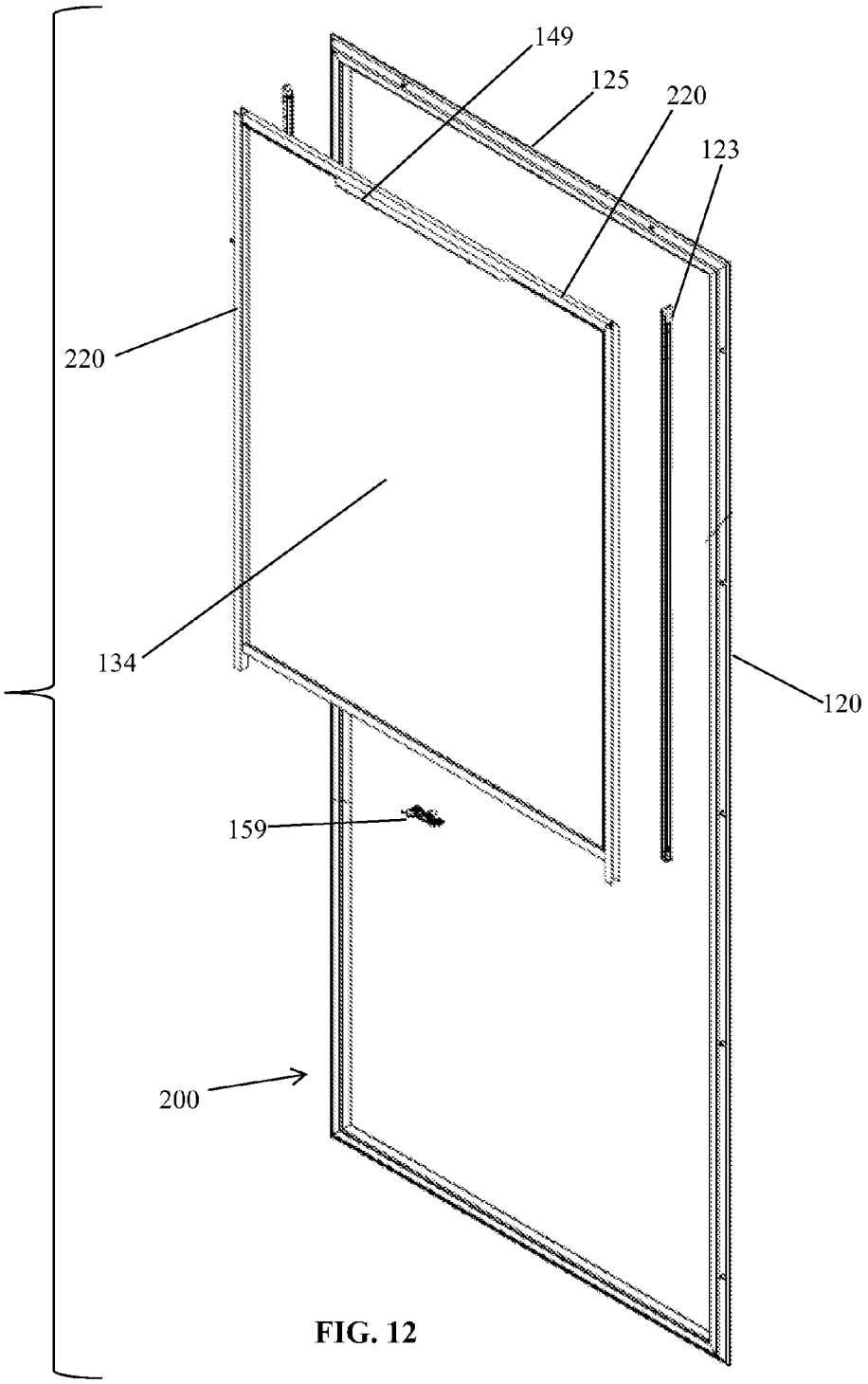
FIG. 12 is an exploded view of a self-storing glass sub-assembly and slidable glass section.

FIG. 11 illustrates an exploded view of an embodiment of a self-storing glass sub-assembly. In one or more embodiments, each track side member 125 may couple to one or more protruding tracks 120. A corner key 142, as previously described, may provide support at each corner for the track side members 125 and the protruding tracks 120. FIG. 12 illustrates an exploded view of an exemplary self-storing glass sub-assembly.

Figure 6:
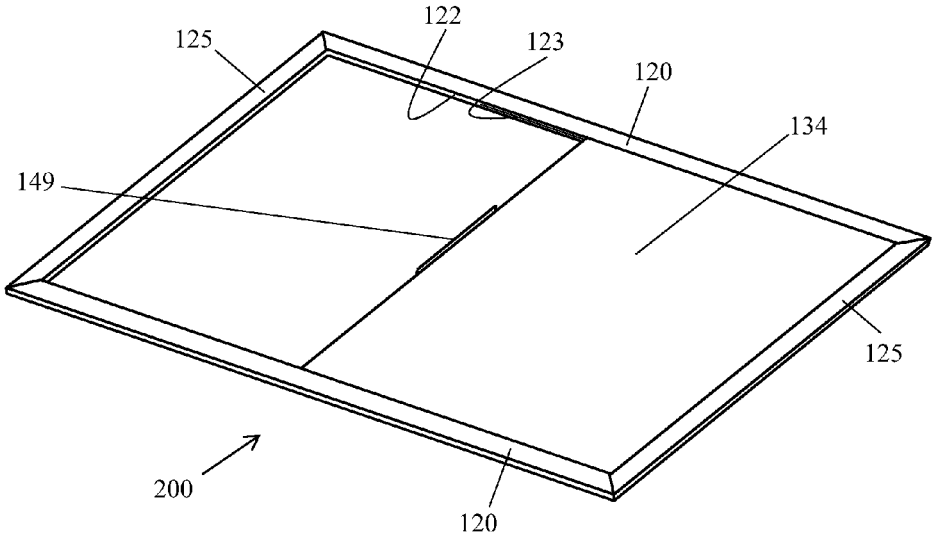
FIG. 6 is a perspective view of a self-storing glass sub-assembly.

One example of a self-storing glass sub-assembly 200 is shown in FIG. 6. Embodiments of the self-storing glass sub-assembly 200 may comprise opposing protruding track 120 members and opposing track side members 124, 125. Embodiments of the track side members 124, 125 and the protruding tracks 120 are described elsewhere in this document. Movement of the movable glass section 134 may be enhanced or facilitated by the counter balance spring 123 loaded inside a balance mechanism contained within the self-storing glass sub-assembly 200. In one or more embodiments, the counter balance spring 123 is positioned within or proximate the first channel 122 and configured such that moveable glass section 134 may rest or stop at any point along the self-storing glass sub-assembly 200.

Figure 8:
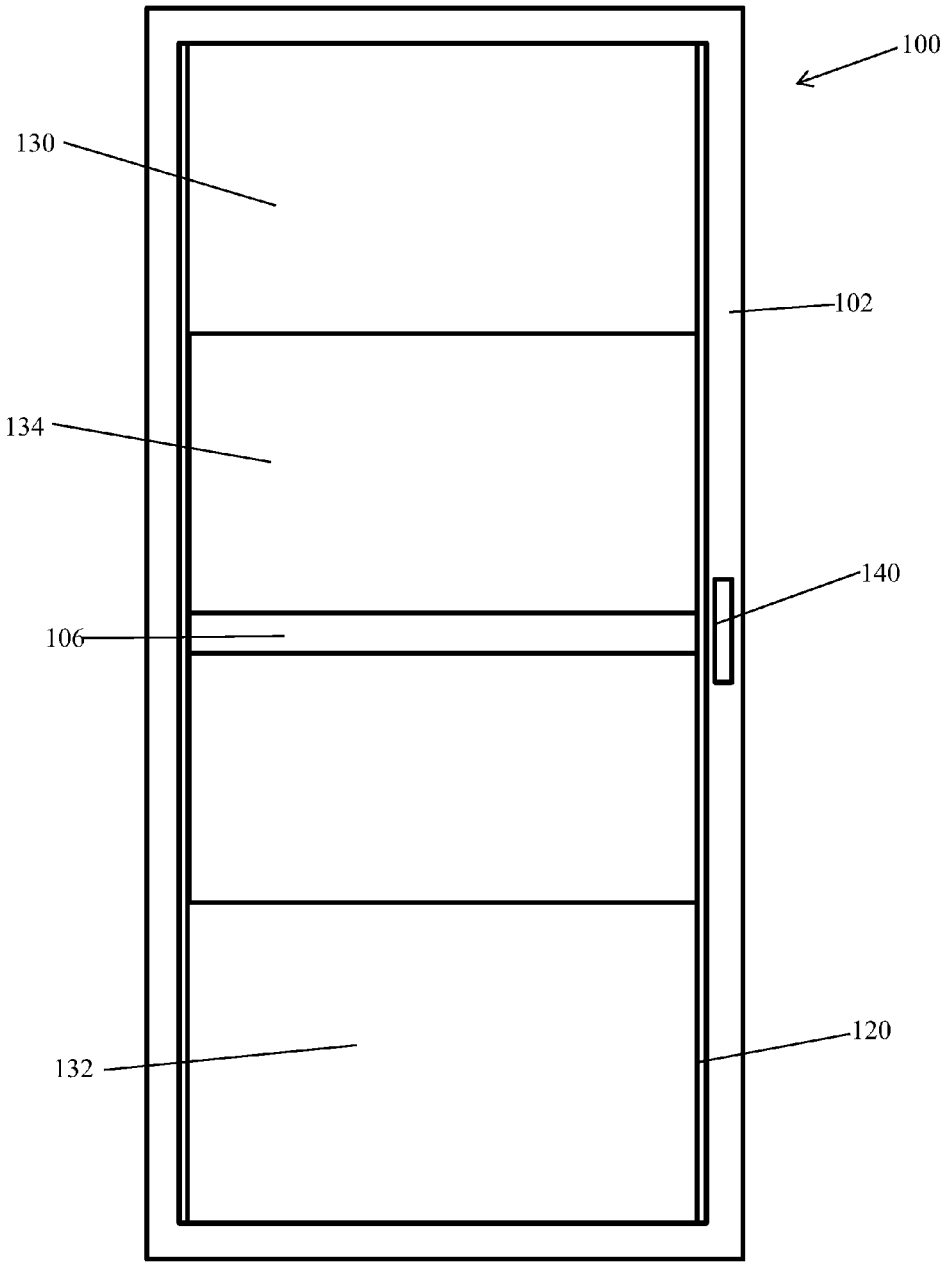
FIG. 8 is a front view of a door assembly.

For example, a user may move the movable glass section 134 to partly cover the first glass section 132 (or first portion 108 of the door frame 100) and partly cover the screen section 132 (or second portion 110 of the door frame 100), as shown in FIG. 8. When released in this position, the counter balanced moveable glass section 134 remains in this position without the assistance of any other locking or latching elements. Likewise, the counter balance allows the moveable glass section 134 to be moved anywhere along the self-storing glass sub-assembly 200 and remain in that position when released without the assistance of any other locking or latching elements. In FIG. 6, the moveable glass section 134 is positioned adjacent one of the two track side members 125.

Figure 14:
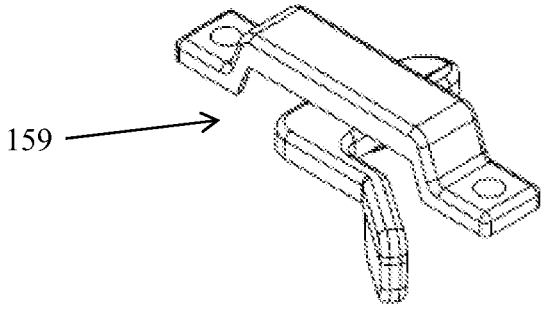
FIG. 14 is a perspective view of a latching element.

The self-storing glass sub-assembly 200 may further comprise a latching element 159 (shown in FIGS. 12 and 14) that temporarily couples the movable glass section 134 to the self-storing glass sub-assembly 200 at the top of the single track framing unit 200. Such a temporary coupling secures the movable glass section 134 in a raised position, thus completely or substantially covering the fixed screen section 130 if the screen section 130 is coupled above the fixed glass section 132. The latching element 159 may comprise any element that allows the movable glass section 134 to be removably coupled to the top section of the single track framing unit 200. In other embodiments, a latching element 159 may be located between the first 108 and second 110 portions of the door frame 100, or rather between the fixed screen section 130 and the fixed glass section 132. In such an embodiment, the latching element 159 may likewise hold the movable glass section 134 in the upper position, providing additional support to hold the movable glass section 134 in place.

Figure 10:
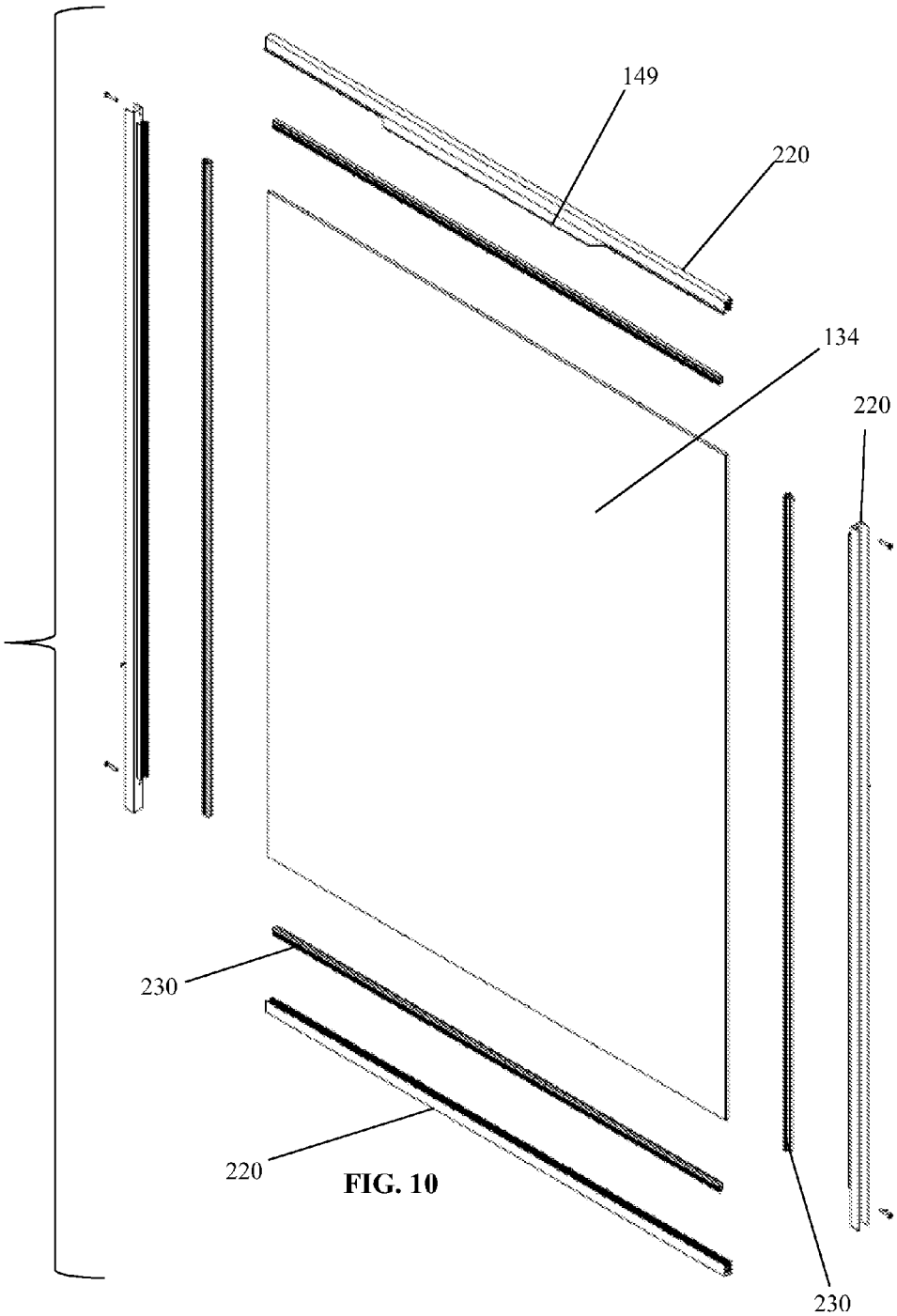
FIG. 10 is an exploded view of a slidable glass section.

FIG. 10 illustrates an exploded view of an exemplary sliding glass assembly that includes the second glass section 134. In one or more embodiments, the sliding glass assembly may comprise side members 220 and weather strips 230 that couple to the second glass section 134. In some embodiments, the hand hold element 149 extends from a side member 220.

The self-storing glass sub-assembly 200 may further comprise a hand hold element 149. The hand hold 149 may comprise any element that allows a user to more easily grasp or grip the movable glass section 134 to move the movable glass section 134 to various positions along the self-storing glass sub-assembly 200. In particular embodiments, the hand hold 149 unit is a fin extending perpendicularly from and coupled to or part of a frame around the moveable glass section 134.

Figure 3:
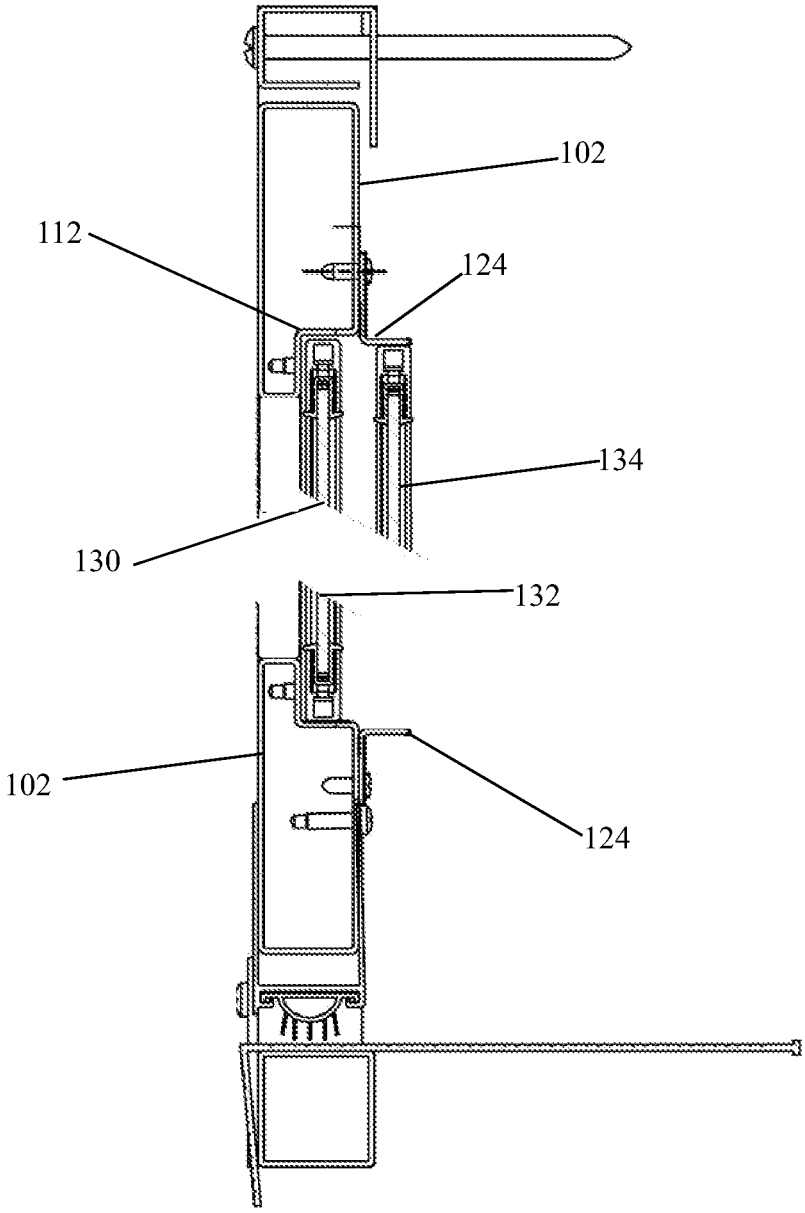
FIG. 3 is a cross sectional view of a door assembly as view from line 3 of FIG. 1.

FIG. 3 illustrates a partial cross-sectioned view of an embodiment of a self-storing security door assembly taken along line 3 of FIG. 1 and showing the bottom portion and the top portion thereof. Embodiments of the self-storing glass sub-assembly 200 further comprise two opposing track side members 124 each coupled to opposing protruding tracks 120. Although the track side members 124 shown in FIG. 3 comprise a substantially planar protrusion that extends outward from the door frame 100, other embodiments of the track side members comprise a first channel 122 similar to that described in relation to the first channel 116 of the protruding track 120.

Figure 4:
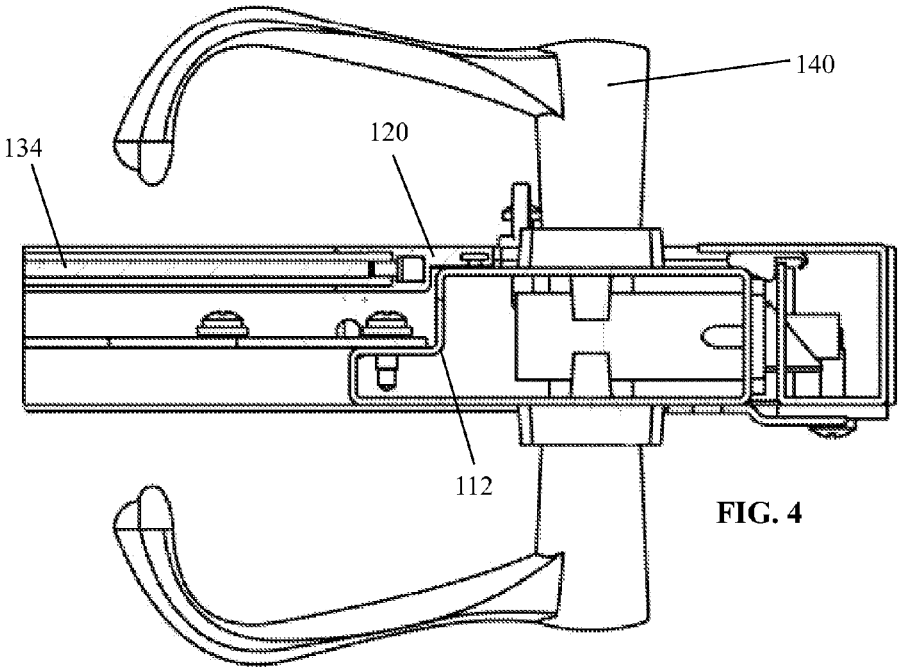
FIG. 4 is a cross sectional view of a door assembly as view from line 4 of FIG. 1.

FIG. 4 illustrates a partial cross-sectioned view of the handle area of the self-storing security door assembly taken along line 4 of FIG. 1. In this and other embodiments, the self-storing security door assembly is improved over previous door assemblies due to the low profile nature of the fixed and movable sections of the door assemblies. By coupling the fixed sections 130, 132 of the door assembly within the recessed track 112 of the door frame 100 and providing a slim or low profile self-storing glass sub-assembly 200 over the fixed sections, more room is present between the door handle 140 and the movable glass section 134. Due to the positioning of the cross-sectioning shown in FIG. 4, neither the fixed first glass section 132 nor the fixed screen section 130 is visible.

Furthermore, the handle 140 of the self-storing security door assembly may also be configured to be reversible. For example, a user may remove the handle 140 and locking element of the door frame 100, rotate, and then reinsert them into the door frame 100 to adapt for a reversed door opening.

Figure 5:
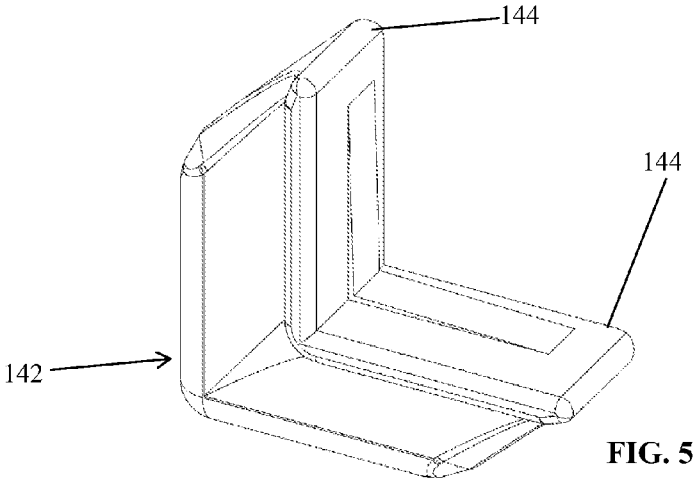
FIG. 5 is a front view of a corner key element.
Figure 7:
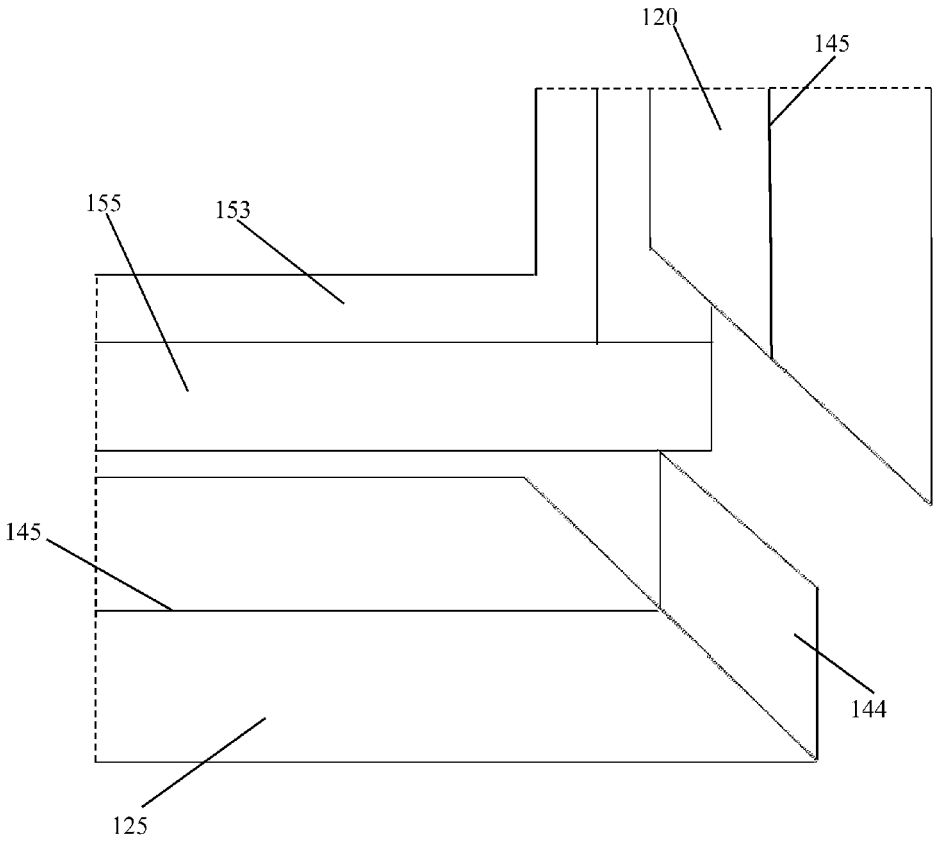
FIG. 7 is a partial front view of a self-storing glass sub-assembly a track side member separated from a protruding track member.

FIG. 5 illustrates an embodiment of a corner key 142, and FIG. 7 illustrates an embodiment of a corner key 142 partially in use with a single track framing unit 200. In one or more embodiments, a corner key 142 may comprise two coupling elements 144 coupled together at a corner. In particular embodiments, corner key 142 is substantially planar, while in other embodiments, similar to the embodiment shown in FIG. 5, the two coupling elements 144 are angled from one another. Particular embodiments include one or more walls that protrude from the coupling elements opposite the substantially perpendicular angle formed by the intersection of the two coupling elements 144. Some embodiments comprising the walls that protrude from the back side of the coupling elements may comprise rounded walls configured to complement or otherwise mate with openings on the track side member 125 or protruding track 120. The corner key 142 may comprise similar or different sizes, edges, tips, and the like. In an embodiment, one coupling element 144 may be shorter or smaller than the second coupling element 144. In this or other embodiments, one coupling element 144 may comprise squared edges, while the other coupling element 144 comprises rounded edges.

As shown in one exemplary embodiment in FIG. 7, the corner key 142 may be sized to fit within the self-storing glass sub-assembly 200, each one of the two coupling elements 144 fitting into a separate piece (protruding track 120 or track side member 125) of the self-storing glass sub-assembly 200. In embodiments similar to that shown in FIG. 7, one coupling element 144 is inserted into an embodiment of a track side member 125, and the other coupling element is inserted into the protruding track 120. Embodiments of the track side member 125 and the protruding track 120 may further comprise an inward track, ridge or guide 145 the more firmly secures the coupling element 144 within the respective track side member or protruding track 120.

Once inserted, the corner key 142 holds two pieces of the single track unit together in a substantially perpendicular and stable angle. In a particular embodiment, a corner key is utilized at each of the four corners of an assembly self-storing glass sub-assembly 200, coupling one protruding track 120 to one track side member 125. The corner key 142 aids in the reversibility feature of the door assembly and may comprise any element that assists in holding the tracks together at the intersection of vertical and horizontal pieces of the self-storing glass sub-assembly 200. For example, if a user has the need to rotate the door assembly (to move the handle 140 and hinges 104 to opposite sides, as previously described), the user may remove the self-storing glass sub-assembly 200 from the main door frame 100. The corner keys 142 allow the self-storing glass sub-assembly 200 to stably remain together, even after the self-storing glass sub-assembly 200 is removed from the main door frame 100. Without the corner keys, the flimsy nature of the aluminum (of an exemplary embodiments) self-storing glass sub-assembly 200 may result in an unstable framing unit easily susceptible to bending and breaking once removed from the main frame 100.

FIG. 7 further illustrates an embodiment of a safety stop 155 that may be coupled or mounted on a self-storing glass sub-assembly 200. The safety stop 155 may be positioned proximate the top, the bottom, or both the top and the bottom of the self-storing glass sub-assembly 200. In some embodiments, the safety stop 155 fits within the first channel 122 of the protruding track 120, while in other embodiments the safety stop is coupled to or extends from the track side member(s) 124, 125. The safety stop 155 may comprise any configuration that prevents the sliding second glass section 134 from sliding out of or beyond the first channels 122 of the protruding tracks. Alternatively or additionally, the safety stop 155 may comprise any configuration that provides a softer surface 153 that prevents the sliding second glass section 134 from breaking if the sliding second glass section slams against the top or the bottom of the self-storing glass sub-assembly 200. The safety stop 155 may further prevent the sliding second glass section 134 from pinching a user's fingers between the self-storing glass sub-assembly 200 and the movable glass section 134. The safety stop 155 may comprise any element that prevents the movable glass section from contacting the bottom of the single track framing unit, such as but not limited to a ridge in the first channel 122, and additional piece inserted into the first channel 122, a limit near the bottom of the track, and the like. Like the screen 130 and glass 132 sections, the self-storing glass sub-assembly 200 is 180 degree rotatable for mounting within the main door frame 100 to enable the main door frame 100 to be installed with the door handle 140 on either the right or left with the internal components all oriented correctly.

Although not described in greater detail in the document, one or more embodiments of a self-storing security door assembly may further comprise a lock-side jamb, a lock-side z-bar jamb, a bug sweep, an expander bar, a door closer and wind chain, and various mounting screws suitable for coupling certain aspects of the door assembly together. Utilization of these elements will become apparent to a person having skill in the art after reviewing the disclosures presented herein.

Also contemplated herein is a method for installing a self-storing security door assembly. One or more embodiments of the method may comprise determining which direction a self-storing security door assembly should swing on a door jamb. If the hinges 104 of the door frame 100 are one the wrong side for the desire direction of swinging, the door frame 100 may be reversed. Accordingly, one or more embodiment of a method for installing a self-storing security door assembly may comprise removing a single track framing unit 200 from the door frame 100, and removing a bottom bug sweep and/or expander bar from the door frame 100. By manufacturing particular ones of the components to be symmetrical and reversible, the left- or right-open nature of the door mounted in the door frame can be chosen at installation rather than pre-manufactured as a right- or left-handed door.

A method may further comprise removing and reversing a fixed first glass section 132 and a fixed screen section 130 from the door frame 100. Removing the fixed first glass section 132 and the fixed screen section 130 from the door frame 100 may comprise removing bolts holding the fixed screen section 130 and removing bolts holding the fixed first glass section 130, then separating the sections 130, 132 from the door frame 100.

Reversing a fixed first glass section 132 and a fixed screen section 130 may, in one or more embodiments, comprises placing the fixed first glass section 132 where the fixed screen section 130 was prior to removal, and placing the fixed screen section 130 where the fixed first glass section was prior to removal. Bolts may be used to fix the first glass section 132 and the fixed screen section to the door frame 100. One or more embodiments of a method for installing a self-storing security door assembly may further comprise rotating the self-storing glass sub-assembly 200 and coupling the self-storing glass sub-assembly 200 to the door frame 100. Reversing a fixed first glass section 132 and a fixed screen section 130 may, in one or more embodiments, further comprising revising a door top and side jambs to change a swing direction.

One or more embodiments of a method for installing a self-storing security door assembly may further comprise fitting the self-storing security door assembly to the door opening by measuring the inside height of the door opening and trimming the jambs to fit within the door opening. A method may further comprise mounting the self-storing security door assembly to the door opening, and installing a bug sweep and/or an expander bar to the self-storing security door assembly.

It will be understood that implementations are not limited to the specific components disclosed herein, as virtually any components consistent with the intended operation of a method and/or system implementation for a self-storing security door assembly may be utilized. Accordingly, for example, although particular glass sections, screen sections, tracks, side members, counter balance springs, stop elements, latching elements, and the like may be disclosed, such components may comprise any shape, size, style, type, model, version, class, grade, measurement, concentration, material, weight, quantity, and/or the like consistent with the intended operation of a method and/or system implementation for a security door assembly may be used.

In places where the description above refers to particular implementations of screen sections, glass sections, protruding tracks, recessed tracks, side members, counter balance springs, and the like, it should be readily apparent that a number of modifications may be made without departing from the spirit thereof and that these implementations may be applied to other door assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A security door assembly, comprising:

a reversible door frame comprising a first side member coupled to a second side member, a third side member coupled to the second side member opposite the first side member, a fourth side member coupled to the first and third side members opposite the first side member, a freeze bar extending between the second and fourth side members and dividing the door frame into a first portion and a second portion, and a recessed track on an interior edge of each of the second and fourth side members, the door frame configured for mounting in a first position wherein the first side member is a bottom side member of the door frame and in a second position rotated 180 degrees from the first position wherein the first side member is a top side member of the door frame; and a self-storing glass sub-assembly coupled to the door frame and sized to cover the recessed tracks of the door frame, the self-storing glass sub-assembly comprising two opposing protruding tracks each comprising a first channel, two opposing track side members extending between the two protruding tracks, and a second glass section coupled to the self-storing glass sub-assembly and slidable within the first channels of the protruding tracks between a first position at the first portion of the door frame and a second position at the second portion of the door frame.

2. The security door assembly of claim 1, further comprising:

a first glass section coupled to the door frame partially within the recessed tracks of the second and fourth side members, the first glass section sized to cover all of the first portion of the door frame;

a screen section coupled to the door frame partially within the recessed tracks of the second and fourth side members, the screen section sized to cover all of the second portion of the door frame; and a handle coupled to either the second side member or the fourth side member.

3. The security door assembly of claim 2, wherein the self-storing glass sub-assembly comprises a corner key at each corner, each corner key comprising two coupling elements positioned such that a first of the two coupling elements slidably engages within one protruding track and a second of the two coupling elements slidably engages within one track side member to couple the one protruding track and the one track side member at about a 90 degree angle.

4. The security door assembly of claim 3, further comprising at least one safety stop coupled to the self-storing glass sub-assembly proximate at least one of the two track side members.

5. The security door assembly of claim 2, wherein the self-storing glass sub-assembly comprises a counter balance spring mechanism.

6. A security door, comprising:

a reversible door frame comprising a first side member coupled to a second side member, a third side member coupled to the second side member opposite the first side member, and a fourth side member coupled to the first and third side members opposite the first side member;

a freeze bar extending between the second side member and the fourth side member and dividing a first portion of the door frame from a second portion of the door frame;

a self-storing glass sub-assembly removably coupled to the door frame and comprising a second glass section slidably coupled within the self-storing glass sub-assembly, the self-storing glass sub-assembly further comprising one protruding track on each side of the self-storing glass sub-assembly proximate an interior edge of the respective second and fourth side member, each of the protruding tracks comprising a first channel, wherein the second glass section is slidable within the first channel of the protruding tracks between a first position covering substantially all of the first portion of the door frame and at least a second position covering substantially all of the second portion of the door frame, and the self-storing glass sub-assembly is further configured to be removed from the door frame, be rotated 180 degrees and be re-coupled to the door frame;

a recessed track on the interior edge of each of the second and fourth side members, the recessed track forming a second channel between the protruding track and the respective second or fourth side members of the reversible door frame;

a first glass section coupled to the reversible door frame and positioned at least partially within the second channel between the protruding track and the second side member and the recessed track between the protruding track and the fourth side member, the first glass section being sized to cover substantially all of the first portion of the door frame; and a screen section removably coupled to the door frame within the second channels of the second and fourth side members, the screen section sized to cover substantially all of the second portion of the door frame.

7. The security door of claim 1, wherein the second glass section is movable between the first position, the second position, and a third position partially covering both the first glass section and the screen section.

8. The security door of claim 7, wherein the self-storing glass sub-assembly further comprises a counterbalance spring mechanism coupled to the second glass section and configured to maintain the second glass section positionally within the first channels.

9. The security door of claim 8, further comprising a latching element that removably couples the second glass section to the protruding tracks when the second glass section is in the second position.

10. The security door of claim 8, further comprising a hand hold element extending from the second glass section.

11. The security door of claim 8, further comprising a handle removably coupled to either the second side member or the fourth side member proximate the freeze bar, wherein the freeze bar is positioned approximately halfway between the first side member and the second side member.

12. The security door of claim 8, wherein the self-storing glass sub-assembly further comprises:

two track side members each extending between the two protruding tracks; and four corner keys, each corner key of the four corner keys coupling one protruding track of the two protruding tracks to one track side member of the two track side members at a different corner of the self-storing glass sub-assembly.

13. The security door of claim 12, wherein each corner key of the four corner keys comprises two coupling elements positioned such that a first of the two coupling elements slidably engages within one protruding track and a second of the two coupling elements slidably engages within one track side member to couple the one protruding track and the one track side member at a 90 degree angle.

14. The security door of claim 13, further comprising a safety stop coupled to the self-storing glass sub-assembly proximate one of the two track side members.

* * * * *